United States Patent [19]

Nakamura

[11] Patent Number: 4,626,748

[45] Date of Patent: Dec. 2, 1986

[54] ELECTRONIC FLASH OF SERIES CONTROLLED TYPE

[75] Inventor: Hiroaki Nakamura, Hachioji, Japan

[73] Assignee: Olympus Optical Company, Ltd., Tokyo, Japan

[21] Appl. No.: 660,492

[22] Filed: Oct. 12, 1984

[30] Foreign Application Priority Data

Jan. 6, 1984 [JP] Japan ..... 59-695

[51] Int. Cl.[4] ..... H05B 37/00; H05B 39/00; H05B 41/14

[52] U.S. Cl. ..... 315/241 P; 315/151; 315/159; 354/416; 354/417

[58] Field of Search ..... 315/241 P, 151, 159; 354/416, 417, 145.1

[56] References Cited

U.S. PATENT DOCUMENTS 3,849,703 11/1974 Shimamura et al. ..... 315/151 X
4,298,826 11/1981 Nakayama ..... 315/241 P X
4,344,020 8/1982 Horinishi ..... 315/241 P
4,522,479 6/1985 Yamada et al. ..... 315/241 P X

FOREIGN PATENT DOCUMENTS 48-17333 5/1973 Japan .

*Primary Examiner*—Saxfield Chatmon
*Attorney, Agent, or Firm*—Louis Weinstein

[57] ABSTRACT

An electronic flash of series controlled type is provided. It comprises a series connection of a flash discharge tube and a main thyristor, which series connection is further connected in series with a thyristor which forms a reverse charging path for a commutating capacitor. The series combination of the flash discharge tube, the main thyristor and the last mentioned thyristor is connected in parallel with a main capacitor. A diode is connected in series with the commutating capacitor so that their series combination is in parallel with the reverse charging thyristor. The reverse charging thyristor is rendered conductive as the main thyristor is rendered conductive so as to establish a reverse charging path for the commutating capacitor therethrough when a commutating operation is to be performed. This prevents a reverse charging current to the commutating capacitor from passing through the flash discharge tube, thus enabling an accurate control over the amount of exposure produced by flashlight.

14 Claims, 10 Drawing Figures

ELECTRONIC FLASH OF SERIES CONTROLLED TYPE

BACKGROUND OF THE INVENTION

The invention relates to an electronic flash of series controlled type, and more particularly, to such an electronic flash which includes a switching element connected in series with a circuit loop to feed a flash discharge tube from a main capacitor and which is turned on and off to control the emission of flashlight from the tube.

A conventional electronic flash of series controlled type is constructed in a manner as illustrated in FIG. 1. Specifically, a booster power supply 10 comprising a DC/DC converter which converts the electromotive force of a low voltage source such as a dry cell to a higher value has its negative terminal connected to a bus $l_1$ and its positive terminal connected to a bus $l_2$ through a rectifier diode D1. A main capacitor $C_M$ is connected across the buses as is a charging complete indicator circuit formed by a series combination of a resistor R1 and a neon tube N. A starter circuit 20 is also connected across the buses $l_1$, $l_2$, and a series combination of a flash discharge tube XL and a main thyristor SCR1 is also connected thereacross. The junction between the cathode of the discharge tube XL and the anode of the thyristor SCR1 is connected through a series combination of a commutating capacitor Cc and a commutating thyristor SCR2 to the bus $l_1$. The opposite ends of the capacitor Cc are connected to the buses $l_1$, $l_2$, respectively, through resistors R2, R3, respectively, thus allowing this capacitor to be charged. The commutating thyristor SCR2 has its gate connected to a control output of a photometric circuit 30.

Synchro contacts X which are disposed within a camera, not shown, have their one terminal connected to an input of the starter circuit 20. The starter circuit 20 has a first control output which is connected to the trigger electrode $XL_T$ of the flash discharge tube XL and a second control output which is connected to the gate of the main thyristor SCR1.

In operation, when the synchro contacts X are closed, a high voltage trigger signal a is applied to the trigger electrode $XL_T$ of the discharge tube XL from the first control output, and simultaneously a proper control signal b which is effective to fire the main thyristor SCR1 is applied from the second control output of the starter circuit 20. The flash discharge tube XL then initiates the emission of flashlight. An object being photographed is illuminated by such flashlight, and reflected light therefrom impinges upon the photometric circuit 30 which is then operative to provide an integral of such reflection until the integral reaches a value which is sufficient to provide a proper exposure, whereupon the photometric circuit 30 delivers, at its control output, an emission terminate signal c which is effective to fire the commutating thyristor SCR2. Accordingly, as the thyristor SCR2 is fired, the commutating capacitor Cc which has been charged through the resistors R2 and R3 now reversely biases the main thyristor SCR1, thus turning it off to terminate the emission of flashlight from the dishcarge tube XL.

In the described operation of the conventional electronic flash, the luminance of emission from the discharge tube XL may be represented as shown in FIG. 2.

Referring to FIG. 2, the emission is initiated at time $t_0$, and the terminate signal c is generated at time $t_1$.

After time $t_1$, or after the commutating thyristor SCR2 is fired to turn the main thyristor SCR1 off, the commutating capacitor Cc begins to be charged to the opposite polarity through a path including the bus $l_2$, the discharge tube XL, commutating capacitor Cc, commutating thyristor SCR2 and the bus $l_1$. This means that an excess amount of emission occurs as indicated by a hatched area in FIG. 2. The greater the amount of charge which remains on the main capacitor $C_M$, or the less the distance to an object being photographed, the degree of excess emission will be greater. Hence, if a camera has a preset F-value of "4", the optimum F-value will increase toward the smaller distance, as indicated in FIG. 3 graphically, and hence there will result an overexposure if the preset F-value is used.

While there is proposed the provision of a coil between the bus $l_2$ and the discharge tube XL so as to smooth out the rising and falling response of the emission luminance to thereby reduce the excess emission, the described problem cannot be solved even though it is effective to a degree.

To accommodate for this, there is a proposal (see Japanese Patent Publication No. 17,333/1973), as shown in FIG. 4, in which a thyristor SCR3 is connected between the bus $l_2$ and the junction between the commutating capacitor Cc and resistor R3, and in which a diode D2 is connected between the junction between the commutating capacitor Cc and resistor R3 and the junction between the discharge tube XL and the main thyristor SCR1. This arrangement permits the thyristor SCR3 to be fired in response to a signal d from the photometric circuit 30 at the same time as the main thyristor SCR1 is turned off, allowing the majority of the reverse charging current to the commutating capacitor Cc, which occurs after the main thyristor SCR1 is turned off, to pass through the thyristor SCR3, thus minimizing the current flow through the discharge tube XL. In this manner, the excess emission is reduced as compared with the circuit arrangement shown in FIG. 1. However, because the thyristor SCR3 is connected in parallel with the discharge tube XL, the magnitude of the excess emission is not reduced to a negligible value, and hence the problem remains unsolved.

SUMMARY OF THE INVENTION

It is an object of the invention to provide an electronic flash of series controlled type which prevents an excess emission from occurring after a command to terminate the emission of flashlight.

In the electronic flash of series controlled type according to the invention, a switching element which is rendered conductive in synchronism with an emission trigger signal applied to a flash discharge tube is connected in a circuit loop which feeds a series combination of the flash discharge tube and a main switching element from a main capacitor. A commutating capacitor has its one end connected to the switching element so as to prevent a reverse charging current to the commutating capacitor from passing through the flash discharge tube.

In this manner, when the main switching element is rendered non-conductive in order to terminate the emission from the flash discharge tube, a current flow through the discharge tube is prevented, thus avoiding the occurrence of an excess emission. This is illustrated in FIG. 2 by a curve indicated in broken lines. In this manner, the invention brings forth an advantage that an accurate emission response can be obtained. As a consequence, when the invention is applied to an electronic flash of automatic emission control type, an amount of exposure having a very precisely determined value is assured for a wide range of distances as indicated graphically by broken lines in FIG. 3.

In addition, when the invention is applied to an electronic flash in which a guide number is manually changed, a very accurate GN (guide number)-value is advantageously obtained.

DESCRIPTION OF PREFERRED EMBODIMENTS

Figure 1:
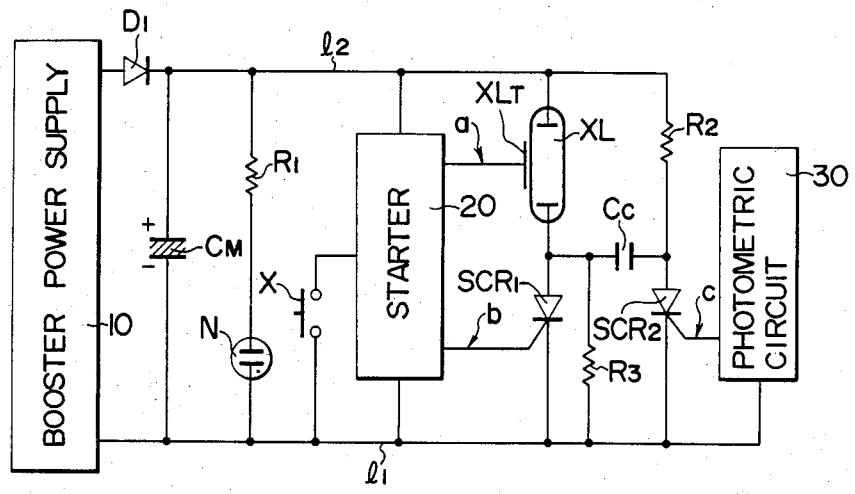
FIG. 1 (PRIOR ART)
FIG. 1 is a circuit diagram of an exemplary electronic flash of series controlled type of the prior art.
Figure 2:
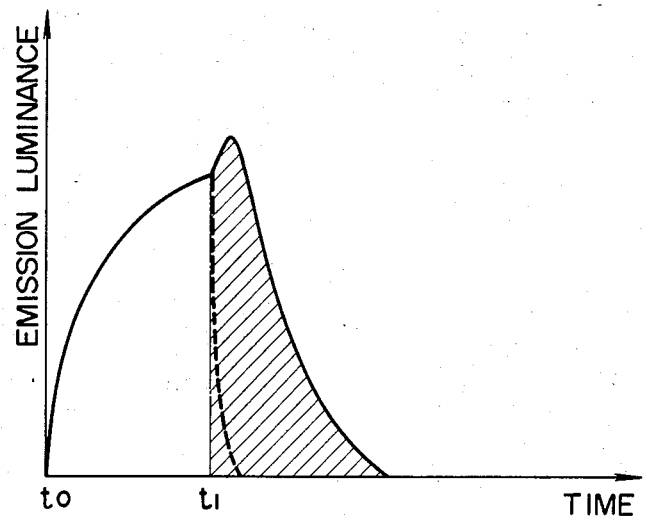
FIG. 2 (PRIOR ART)
FIG. 2 graphically shows the emission luminance response of the electronic flash shown in FIG. 1.
Figure 3:
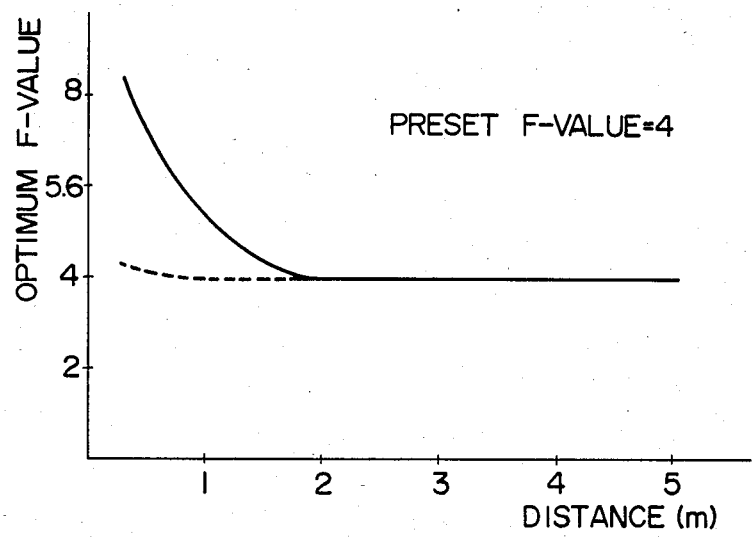
FIG. 3 (PRIOR ART)
FIG. 3 graphically plots the F-value against the distance to an object being photographed for the electronic flash shown in FIG. 1.
Figure 4:
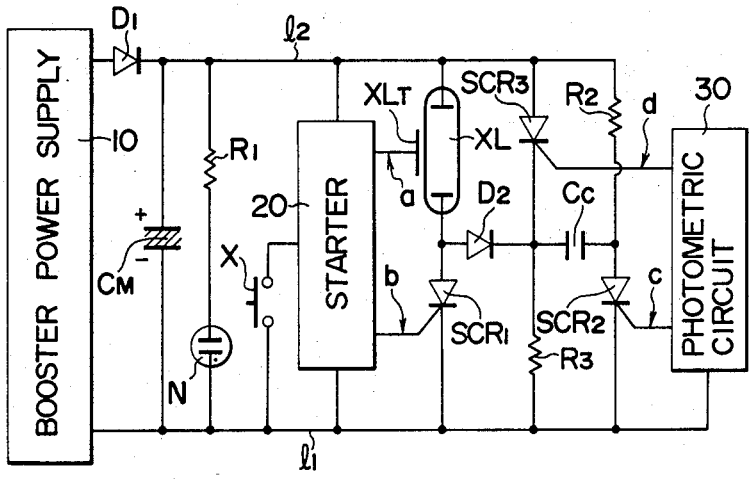
FIG. 4 (PRIOR ART)
FIG. 4 is a circuit diagram of another example of an electronic flash of series controlled type of the prior art.
Figure 5:
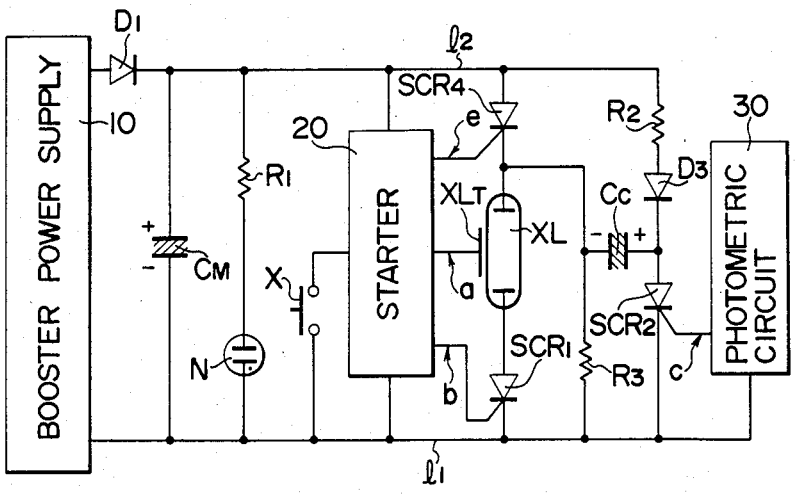
FIG. 5 is a circuit diagram of an electronic flash of series controlled type according to one embodiment of the invention.

Referring to FIG. 5, there is shown an electronic flash according to one embodiment of the invention. It is to be understood that corresponding parts to those shown in FIG. 1 are designated by like reference characters in this Figure. It will be seen that a series combination of a main thyristor SCR1, a flash discharge tube XL and a further thyristor SCR4 is connected across the buses $l_1$, $l_2$. The thyristor SCR4 has its anode connected to the bus $l_2$, its cathode to the anode of the discharge tube XL and its gate connected to a third control output of a starter circuit 20. The starter circuit 20 delivers a control signal e at its third control output which is applied to the gate of the thyristor SCR4. It will be noted that a commutating capacitor Cc has its one end connected to the junction between the cathode of the thyristor SCR4 and the anode of the discharge tube XL. A diode D3 is connected between the junction between the other end of the capacitor Cc and the anode of the thyristor SCR2 and the resistor R2, with its cathode connected to the capacitor Cc. The purpose of the diode D3 is to prevent a discharge of the capacitor Cc through the thyristor SCR4 when the latter is turned on. However, the provision of such diode can be avoided if the series resistor R2 has a sufficient resistance to prevent such discharge. In other respects, the arrangement is similar to that shown in FIG. 1, and hence the individual components will not be described in detail.

In operation, when synchro contacts X are closed, the starter circuit 20 delivers control signals b and e, which fire the main thyristor SCR1 and the thyristor SCR4, respectively. At the same time, a high voltage trigger signal a from the starter circuit 20 is applied to the trigger electrode $XL_T$ of the discharge tube XL, which therefore initiates the emission of flashlight. Concurrently with the initiation of emission of flashlight, the photometric circuit 30 forms an integral of reflected light from an object being photographed, and when the integral reaches a value which is sufficient to provide a proper exposure, the photometric circuit 30 develops a control signal c at its control terminal which fires the commutating thyristor SCR2. When the commutating thyristor SCR2 is fired, the commutating capacitor Cc, which has been charged through a path including the bus $l_2$, resistor R2, diode D3, commutating capacitor Cc, resistor R3 and the bus $l_1$, now discharges to reversely bias the main thyristor SCR1 through the commutating thyristor SCR2 and the discharge tube XL, thus turning the main thyristor off. The thyristor SCR4 is maintained conductive as it is fired simultaneously with the main thyristor SCR1, as is the commutating thyristor SCR2. Accordingly, the reverse charging current to the commutating capacitor Cc now follows a path including the bus $l_2$, thyristor SCR4, commutating capacitor Cc, thyristor SCR2 and the bus $l_1$, thus causing no current flow through the discharge tube XL. It will thus be seen that there occurs no excess emission. When the reverse charging of the commutating capacitor Cc is complete, the thyristors SCR4 and SCR2 are turned off, so that the commutating capacitor Cc is then re-charged through the resistor R2, diode D3 and the resistor R3 in a direction to store the commutating charge, in preparation to the next emission of flashlight.

Figure 6:
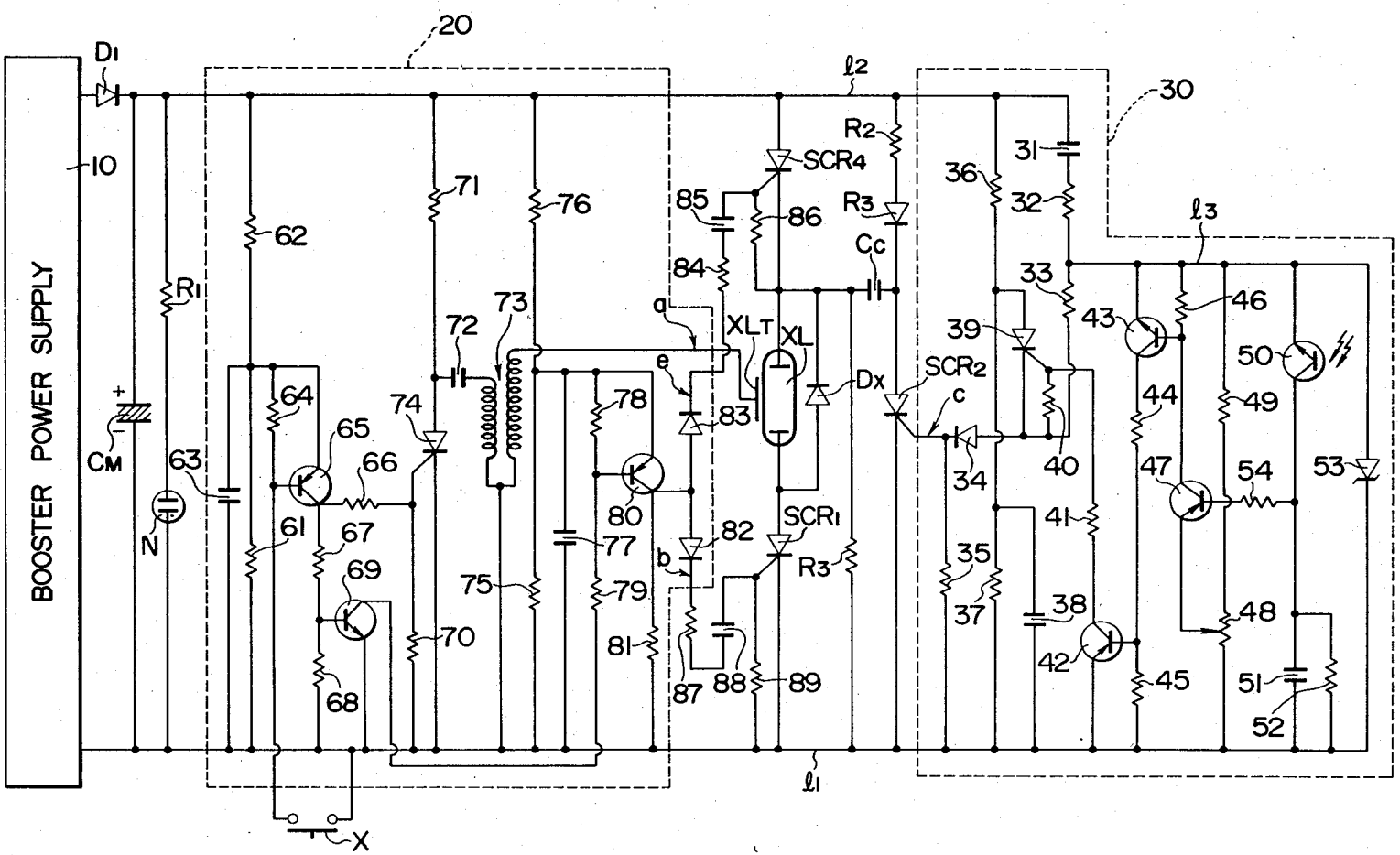
FIG. 6 is a circuit diagram showing the detail of the electronic flash shown in FIG. 5.

FIG. 6 is a circuit diagram showing the detail of the electronic flash shown in FIG. 5. It is to be noted that in the description to follow, parts which have been described previously in connection with FIG. 5 will not be described again. Referring to FIG. 6, it will be noted that the starter circuit 20 includes a voltage divider formed by a series combination of resistors 61, 62 which are connected across the buses $l_1$, $l_2$. The junction between the resistors 61, 62 is connected through a capacitor 63 to the bus $l_1$ and is also connected to the emitter of a PNP transistor 65 and also through a resistor 64 to the base thereof. The collector of the transistor 65 is connected to the bus $l_1$ through a series combination of resistors 67, 68. The junction between the resistors 67, 68 is connected to the base of an NPN transistor 69, which has its emitter connected to the bus $l_1$. The collector of the transistor 65 is also connected through a resistor 66 to the gate of a trigger thyristor 74, the cathode of which is connected to the bus $l_1$ and the anode of which is connected through a resistor 71 to the bus $l_2$ and also connected through a trigger capacitor 72 to one end of a primary winding of a trigger transformer 73. The other end of the primary winding is connected to the bus $l_1$ and also connected to one end of a secondary winding of the transformer 73, with the other end of the secondary winding connected to the trigger electrode $XL_T$ of the discharge tube XL. A resistor 70 is connected between the gate of the thyristor 74 and the bus $l_1$.

Another voltage divider formed by a series combination of resistors 75, 76 is connected across the buses $l_1$, $l_2$, and a capacitor 77 is connected between the junction between the resistors 75, 76 and the bus $l_1$. The junction between the resistors 75, 76 is also connected through a series combination of resistors 78, 79 to the collector of the transistor 69, and also directly connected to the emitter of a PNP transistor 80. The transistor 80 has its base connected to the junction between the resistors 78, 79, and has its collector connected to the bus $l_1$ through a resistor 81. This collector is additionally connected through a diode 83, a resistor 84 and a capacitor 85 to the gate of the thyristor SCR4 to apply a firing voltage thereto, and is also connected through a diode 82, a resistor 87 and a capacitor 88 to the gate of the main thyristor SCR1 to apply a firing voltage thereto. It will be noted that resistors 86 and 89 are connected between the gates and the cathodes of the thyristors SCR4 and SCR1, respectively.

Referring to the photometric circuit 30, it includes a series circuit comprising a capacitor 31, a resistor 32, another resistor 33, diode 34 and a resistor 35, which are sequentially connected in series between the buses $l_2$, $l_1$. The junction between the diode 34 and the resistor 35 is connected to the gate of the commutating thyristor SCR2. Another series circuit of resistors 36, 37 is connected across the buses $l_1$, $l_2$ with the junction between the resistors 36, 37 being connected to the bus $l_1$ through a capacitor 38. The junction between the resistors 36, 37 is also connected to the anode of a thyristor 39, and a bias resistor 40 is connected between the cathode and the gate of the thyristor 39. The gate of the thyristor 39 is connected through a resistor 41 to the collector of a PNP transistor 42, the emitter of which is connected to the bus $l_1$.

The junction between the resistors 32, 33 is connected to a bus $l_3$ which represents a negative supply for the photometric circuit 30. The bus $l_3$ is connected to the emitter of an NPN transistor 43, which has its collector connected through a resistor 44 to the base of the transistor 42, which has its base connected through a resistor 45 to the bus $l_1$.

A resistor 46 is connected between the emitter and base of the transistor 43, and this transistor has its base connected to the movable contact of a variable resistor 48 through the collector-emitter path of a PNP transistor 47. The variable resistor 48 has its one end connected to the bus $l_1$ while the other end thereof is connected through a resistor 49 to the bus $l_3$. The bus $l_3$ is also connected to the emitter of a phototransistor 50, the collector of which is connected to the bus $l_1$ through an integrating capacitor 51, which is shunted by a resistor 52. The junction between the collector of the phototransistor 50 and the capacitor 51 is connected through a resistor 54 to the base of the transistor 47. Finally, the bus $l_3$ is connected to the anode of a Zener diode 53, the cathode of which is connected to the bus $l_1$.

In operation, when synchro contacts X are closed, the potential on the bus $l_1$ is applied to the base of the transistor 65 to turn it on, which causes the gate of the thyristor 74 to assume a high potential to fire this thyristor. When the thyristor 74 is turned on, a high voltage is developed across the secondary winding of the trigger transformer 73, and the trigger signal a is applied to the trigger electrode $XL_T$ of the discharge tube XL.

At the same time, as the transistor 65 is turned on, the transistor 69 is also turned on, which causes the transistor 80 to be turned on. As the transistor 80 turns on, its collector assumes a high level, whereby the emission initiate signal b is supplied through the diode 82 and other elements to the gate of the main thyristor SCR1, thus firing it. Also the control signal e is fed through the diode 83 and associated elements to the gate of the thyristor SCR4, thus firing it. In this manner, the emission of flashlight from the discharge tube XL is initiated. When the discharge tube XL initiates the emission of flashlight, reflected light from an object being photographed impinges upon the phototransistor 50 in the photometric circuit 30, allowing an integrating operation by the capacitor 51 to be initiated. When the integral reaches a magnitude which is established by the variable resistor 48, the transistor 47 is turned on. As the transistor 47 is turned on, the transistor 43 is also turned on as is the transistor 42. When the transistor 42 is turned on, the gate of the thyristor 39 assumes a high level, and thus is fired, accompanying a firing of the commutating thyristor SCR2. When the thyristor SCR2 is fired, the commutating capacitor Cc which is already charged causes the main thyristor SCR1 to be reversely biased, thus turning it off.

It is to be noted that at this time the thyristor SCR4 is maintained conductive as it is fired simultaneously with the main thyristor SCR1, and the commutating thyristor SCR2 is also maintained conductive. Accordingly, the charging current to the commutating capacitor Cc follows a path including the bus $l_2$, thyristor SCR4, commutating capacitor Cc, thyristor SCR2 and the bus $l_1$, without causing any current flow through the discharge tube XL. Hence, no excess emission occurs as experienced in a conventional electronic flash.

The purpose of a diode DX connected across the discharge tube XL is to protect the discharge tube XL from instantaneous reverse bias current and voltage which may be developed as the main thyristor SCR1 is turned off. It is to be understood that the variable resistor 48 is adjusted to preset a total amount of flashlight emitted, in accordance with information relating to film speed, diaphram aperture or the like.

Figure 7:
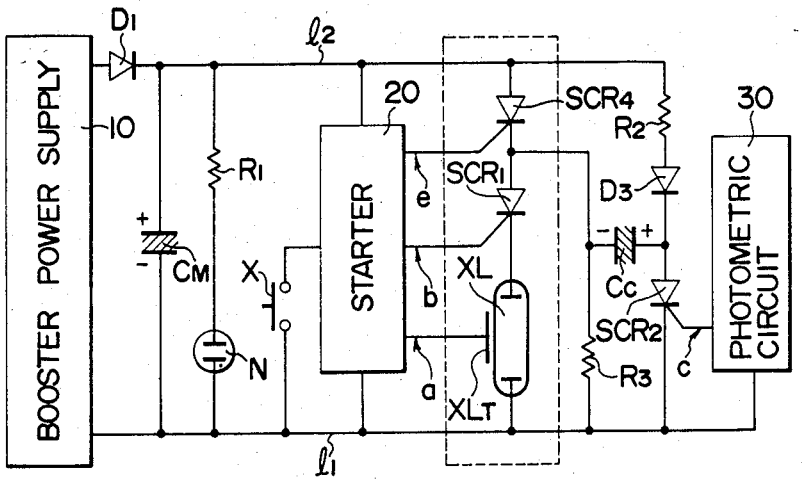
FIG. 7 is a circuit diagram of an electronic flash of series controlled type according to a second embodiment of the invention.

FIG. 7 shows a second embodiment of the invention. The electronic flash of this embodiment is generally similar to the electronic flash shown in FIG. 5 except that the location of the flash discharge tube XL and the main thyristor SCR1 is interchanged. Thus, the discharge tube XL has its cathode connected to the bus $l_1$ and its anode connected to the cathode of the main thyristor SCR1, the anode of which is connected to the cathode of the thyristor SCR4 and also to one end of the commutating capacitor Cc. In other respects, the arrangement is quite similar to that shown in FIG. 5, and hence this embodiment operates in the same manner as the embodiment shown in FIG. 5.

Figure 8:
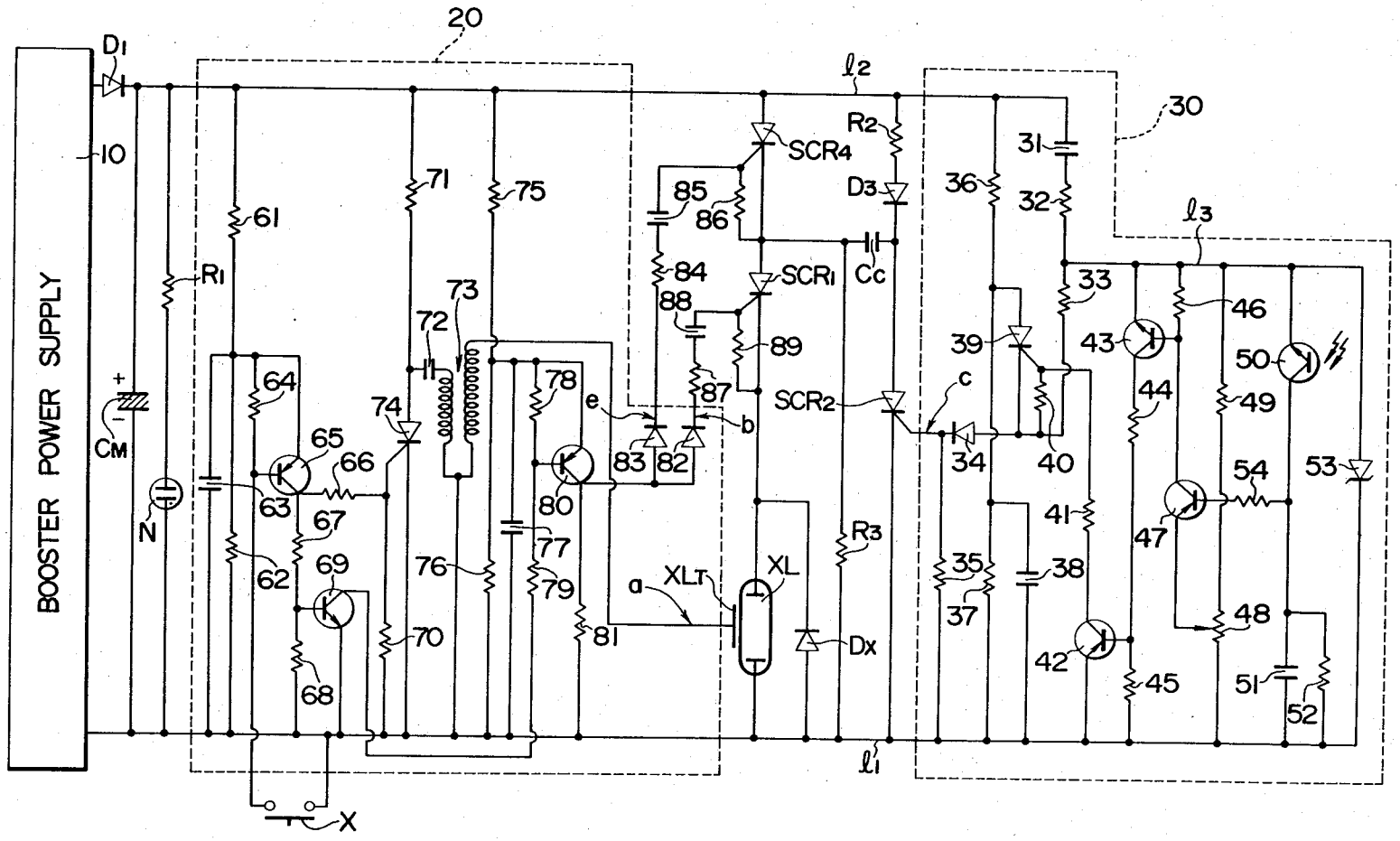
FIG. 8 is a circuit diagram showing the detail of the electronic flash shown in FIG. 7.

FIG. 8 is a circuit diagram showing the detail of the electronic flash shown in FIG. 7. In this circuit diagram, the only distinction over the arrangement of FIG. 6 is the interchanged location of the flash discharge tube XL and the main thyristor SCR1. Accordingly, the operation remains unchanged from the operation of the arrangement shown in FIG. 6.

Figure 9:
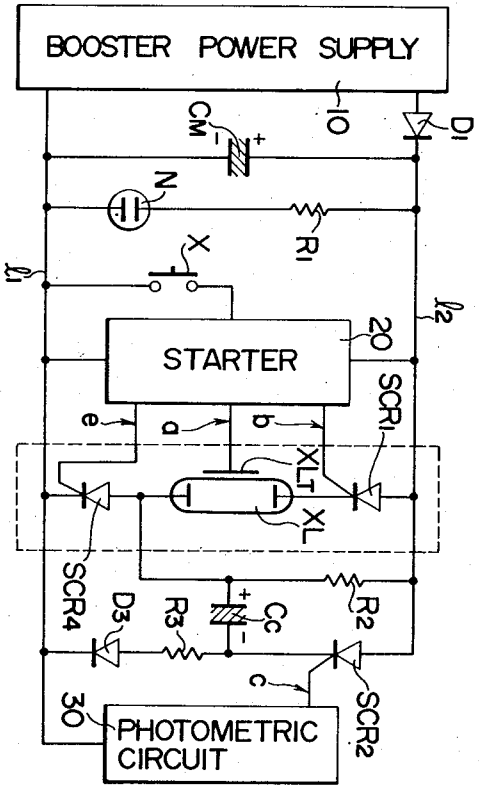
FIG. 9 is a circuit diagram of an electronic flash of series controlled type according to a third embodiment of the invention.

FIG. 9 shows a third embodiment of the invention. The electronic flash of this embodiment is generally similar to the embodiment of FIG. 7 except that the series combination of the main thyristor SCR1 and the flash discharge tube XL has its location interchanged with the thyristor SCR4, with a corresponding change in the connection of the commutating capacitor Cc, the commutating thyristor SCR2 and associated elements. Specifically, the bus $l_2$ is connected to the anode of the main thyristor SCR1, the cathode of which is connected to the anode of the discharge tube XL. The cathode of the discharge tube XL is connected to the anode of the thyristor SCR4, the cathode of which is in turn connected to the bus $l_1$. The commutating capacitor Cc has its one end connected to the anode of the thyristor SCR4 and also connected through resistor R2 to the bus $l_2$. The other end of the commutating capacitor Cc is connected to the cathode of the commutating thyristor SCR2 and is also connected through resistor R3 to the anode of the diode D3, the cathode of which is in turn connected to the bus $l_1$. Accordingly, the commutating capacitor Cc is charged in a direction such that said one end thereof assumes a positive level with respect to the other end. It will be noted that the anode of the commutating thyristor SCR2 is connected to the bus $l_2$.

In operation, in response to the closure of the synchro contacts X, the starter circuit 20 delivers the signals a, b and e to fire the thyristors SCR1 and SCR4 and to trigger the flash discharge tube XL, thus initiating the emission of flashlight therefrom. When the photometric circuit 30 delivers the signal c to fire the commutating thyristor SCR2, the commutating capacitor Cc discharges to reversely bias the main thyristor SCR1 through the discharge tube XL and the commutating thyristor SCR2, thus turning the thyristor SCR1 off. Concurrently, the commutating capacitor Cc then begins to be charged in the reverse direction through the commutating thyristor SCR2 and the thyristor SCR4. Upon completion of the reverse charging of the commutating capacitor Cc, the thyristors SCR2 and SCR4 are turned off, and thereafter the commutating capacitor CC is then charged through the resistors R2, R3 and the diode D3 to store the commutating charge, in preparation for the next emission of flashlight.

Figure 10:
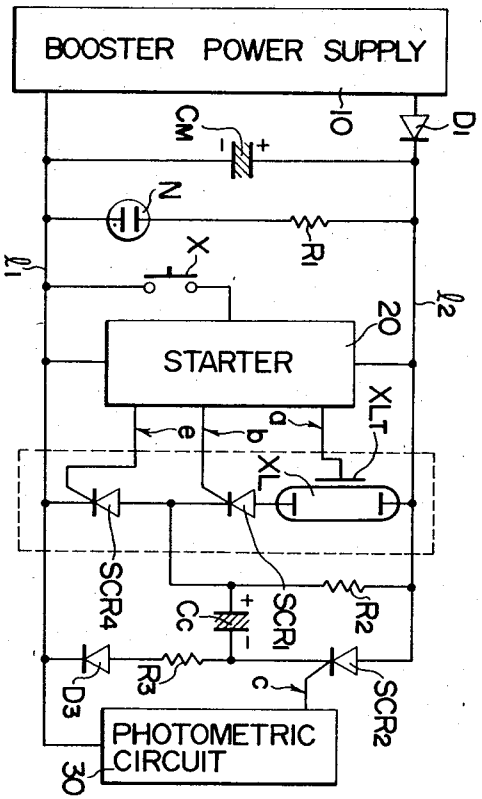
FIG. 10 is a circuit diagram of an electronic flash of series controlled type according to a fourth embodiment of the invention.

FIG. 10 shows a fourth embodiment of the invention. The electronic flash of this embodiment is similar to the electronic flash shown in FIG. 9 except that the location of the discharge tube XL and the main thyristor SCR1 is interchanged. Specifically, the discharge tube XL has its anode connected to the bus $l_2$ and its cathode connected to the anode of the main thyristor SCR1, the cathode of which is connected to the anode of the thyristor SCR4 and to one end of the commutating capacitor Cc. It will be appreciated that the electronic flash of the present embodiment operates in quite the same manner as the electronic flash shown in FIG. 9.

What is claimed is:

1. An electronic flash of series controlled type comprising:

a series connection of a flash discharge tube and a first switching element;

a second switching element connected in series with said series connection, the combination of the second switching element and the series connection being connected in parallel with a main capacitor;

a starter circuit for rendering the first and the second switching element on concurrently and for triggering the flash discharge tube at the same time therewith;

a commutating capacitor having its one end connected to the junction between the series connection and the second switching element;

a third switching element connected to the other end of the commutating capacitor, with the combination of the third switching element and the commutating capacitor being connected in parallel with said series connection;

and an emission terminate circuit for rendering the third switching element conductive.

2. An electronic flash according to claim 1, further comprising a diode connected to the other end of the commutating capacitor so that a series combination of the diode and the commutating capacitor is in parallel with the second switching element for preventing the commutating capacitor from discharging through the second switching element.

3. An electronic flash according to claim 1 in which the first switching element is connected to the cathode of the flash discharge tube.

4. An electronic flash according to claim 1 in which the first switching element is connected to the anode of the flash discharge tube.

5. An electronic flash according to claim 1 in which the second switching element is connected on the anode side of the flash discharge tube so that a series combination of the second switching element, the commutating capacitor and the third switching element which are sequentially connected together is in parallel with the main capacitor.

6. An electronic flash according to claim 1 in which the second switching element is connected on the cathode side of the flash discharge tube so that a series combination of the third switching element, the commutating capacitor and the second switching element which are sequentially connected together is in parallel with the main capacitor.

7. An electronic flash according to claim 2 in which the commutating capacitor has its other end connected to the cathode of the diode and is connected in a charging path which is in parallel with the main capacitor such that it is charged positive on the other end.

8. An electronic flash according to claim 2 in which the commutating capacitor has its other end connected to the anode of the diode and is connected in a charging path which is in parallel with the main capacitor so that it is charged positive on said one end.

9. An electronic flash according to claim 1, further comprising a bypass diode connected in parallel and opposite relationship with respect to the flash discharge tube for preventing a back bias which may be developed during the commutation of the commutating capacitor from being applied to the flash discharge tube.

10. An electronic flash according to claim 1 in which the starter circuit is connected to synchro contacts of a camera so as to begin to operate in response to the closure of the contacts.

11. An electronic flash according to claim 1 in which the emission terminate circuit comprises a photometric circuit which photometrically determines reflected light from an object being determined and produces an emission terminate signal whenever a proper amount of light has been determined.

12. An electronic flash according to claim 1 in which the first to the third switching elements each comprise a thyristor.

13. An electronic flash according to claim 12 in which each thyristor includes a trigger electrode;

the starter circuit being coupled to the trigger electrode of the thyristors connected in series with the flash discharge tube.

14. An electronic flash according to claim 13 wherein said emission terminate circuit comprises a photometric circuit coupled to the trigger electrode of the third switching element.

* * * * *